US006470989B1

(12) United States Patent
Puputti et al.

(10) Patent No.: US 6,470,989 B1
(45) Date of Patent: Oct. 29, 2002

(54) METHOD AND ARRANGEMENT FOR PREVENTING THE PASSAGE OF A MINING VEHICLE

(75) Inventors: Jarmo Puputti; Riku Pulli; Timo Soikkeli, all of Tampere (FI)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/697,169

(22) Filed: Oct. 27, 2000

(30) Foreign Application Priority Data

Oct. 29, 1999 (FI) ..... 19992347

(51) Int. Cl.[7] ..... B60T 7/22
(52) U.S. Cl. ..... 180/275; 340/436
(58) Field of Search ..... 180/274, 275, 180/277, 279; 414/275; 340/436; 701/23; 200/61.44

(56) References Cited

U.S. PATENT DOCUMENTS 3,269,783 A * 8/1966 Kriz ..... 180/275
3,901,346 A * 8/1975 Kohls et al. ..... 180/277
4,237,466 A * 12/1980 Roberts ..... 340/61
5,048,637 A * 9/1991 Lomasney ..... 180/274
5,530,330 A * 6/1996 Baiden et al. ..... 318/580
6,142,252 A * 11/2000 Kinto et al. ..... 180/204
6,163,745 A * 12/2000 Purchase et al. ..... 701/23

* cited by examiner

*Primary Examiner*—Paul N. Dickson
*Assistant Examiner*—David R. Dunn
(74) *Attorney, Agent, or Firm*—Burns, Doane, Swecker & Mathis, L.L.P.

(57) ABSTRACT

The invention relates to a method and arrangement for preventing the passage of preferably an unmanned mining vehicle. The invention is based on the idea of providing a mining vehicle, such as a loading vehicle, with a mast (7) arranged on its upper outer structure and extending above other portions of the vehicle. In connection with the mast there is provided an emergency stop switch. Furthermore, at the upper portion of a mine gallery, or a similar operating site, is provided a barrier boom reachable to the mast for bordering the accepted travel area of the mining vehicle. If the mining vehicle tries to leave the accepted area, the mast hits the barrier boom and thus triggers the switch arranged in connection with the mast, thereby causing the mining vehicle to stop.

17 Claims, 2 Drawing Sheets

METHOD AND ARRANGEMENT FOR PREVENTING THE PASSAGE OF A MINING VEHICLE

FIELD OF THE INVENTION

The present invention relates to a method for preventing the passage of a mining vehicle, preferably an unmanned mining vehicle, the method comprising the defining of an accepted operating range for a mining vehicle provided with a power unit of its own and steered by means of wireless data transfer or an independent navigation system incorporated in the vehicle and controlling that the vehicle stays within the accepted operating range by stopping the vehicle if it tries to leave the operating range.

The present invention further relates to an arrangement for preventing the passage of a mining vehicle, preferably an unmanned mining vehicle, the arrangement comprising a mining vehicle provided with a power unit of its own, the mining vehicle being steered within a predetermined operating range by means of wireless data transfer or an independent navigation system incorporated in the vehicle.

BACKGROUND

Automated and other unmanned mining vehicles, such as vehicles steered from a distant control room on the ground, have been designed for excavation and mining industry with the aim of improving both the safety and working conditions of the staff and to improve productivity. An aspect that must always be taken into account in connection with the use of automated equipment is safety. It is an issue that has to be addressed also when remote-controlled equipment is concerned, because the site of operation is not directly visible to the operator. Legislation on safety at work requires the use of safety arrangements when such equipment is used. Even if a site of operation is normally unmanned, every now and then there are persons and other vehicles, manned and unmanned, moving in the vicinity. In case a vehicle should break away from the area reserved for it, due to an operational disturbance for example, a serious risk of collision might occur. In prior art solutions the accepted operating range of unmanned mining vehicles is defined by using for example photocells and mechanical gates provided with limit switches. This is a fairly simple arrangement for an electrically driven vehicle to which the driving power is supplied over a supply cable from outside the operating range of the vehicle. If the vehicle for some reason tries to leave the accepted area, the photocells or gates detect this and the power supply from the supply cable is switched off. Consequently, the vehicle stops and cannot cause a safety hazard. This system functions well and reliably for mining vehicles, the power supply of which being controllable from the outside of the operating range. The situation is different for independent diesel- and battery-driven mining vehicles and those running on any other independent power source, because they have no fixed connection to the outside of the operating range. Instead, the control data needed for steering and controlling the equipment is transmitted as wireless data transfer from the control site to the vehicle. It is also possible that the vehicle is provided with an independent navigation system, which does not necessarily require any outside control during operation. In either case, it is impossible to arrange an emergency stop based on wireless data transfer alone because in the demanding conditions concerned, disturbances may occur in the radio connection.

OBJECT AND SUMMARY OF THE INVENTION

It is an object of the present invention to provide a method and an arrangement that allows the safety of unmanned mining vehicles to be improved.

The method of the present invention is characterized in that the accepted operating range is defined using at least one horizontal barrier boom arranged at the operating site, above the highest point of the mining vehicle; that the mining vehicle is provided with a mast extending to said barrier boom; and in that when the mining vehicle is at the barrier boom, the mast hits the boom, thereby triggering an emergency stop switch arranged in connection with the mast to stop the mining vehicle.

The arrangement of the present invention is further characterized in that the arrangement comprises a mast arranged at the mining vehicle, the mast being provided to extend above other portions of the vehicle, and in that in connection with the mast there is provided an emergency stop switch which is provided to stop the mining vehicle when the mast hits a horizontal barrier boom defining the accepted operating range of the mining vehicle and arranged within the reach of the mast.

An essential idea of the present invention is that horizontal barrier booms are arranged at a suitable height at the upper part of a mine gallery or a similar operating site to determine an accepted travel range for an unmanned mining vehicle provided with a power unit of its own. The mining vehicle, in turn, is provided with a mast which is higher than other portions of the vehicle, so if the mining vehicle for some reason tries to leave the accepted area, the mast hits the boom, thereby triggering an emergency stop switch arranged in connection with the mast to stop the vehicle. This prevents the vehicle from leaving the predetermined area. Further, an essential idea of a preferred embodiment of the present invention is that movable barrier booms are arranged in mine galleries, the booms being pivotable in a transverse direction with respect to the mine gallery or to the side of it, thereby allowing the accepted travel range of the unmanned vehicle to be conveniently defined.

An advantage of the present invention is that it is now possible to essentially improve the operational safety of unmanned mining vehicles provided with a power unit of their own, such as diesel- or battery-driven vehicles, and to reliably control any exceptional circumstances. A vehicle that strays away from the accepted area causes a mechanical contact between the barrier boom and the emergency stop switch, whereby the movement of the vehicle is stopped before more serious damage is caused. The emergency stop operates mechanically; therefore any disturbances occurring in wireless data transfer as well as other unreliability factors are avoided. The arrangement of the present invention is also simple and economical to manufacture. Moreover, its structure is reliable and substantially maintenance free.

BRIEF DESCRIPTION OF THE DRAWINGS

The invention will be described in greater detail with reference to the accompanying drawings, in which.

DETAILED DESCRIPTION OF THE INVENTION

Figure 1:
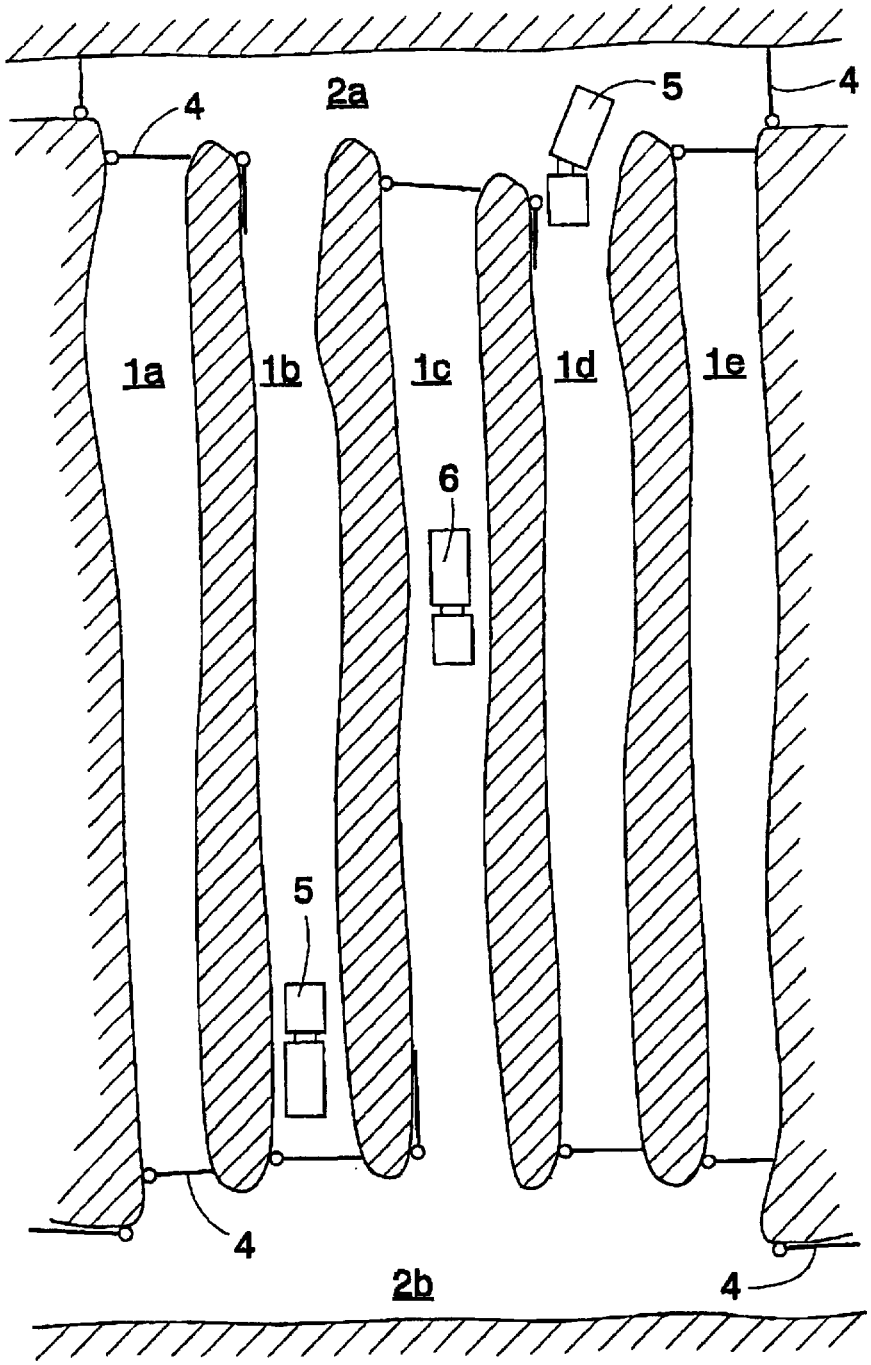
FIG. 1 is a schematic top view of an excavation site where an arrangement of the present invention is applied.

FIG. 1 illustrates a simplified view of an operating site provided with a passage prevention system of the present invention. The site comprises parallel mine galleries 1*a*–1*e* connected via transverse connecting galleries 2*a*and 2*b*. As shown in FIG. 1, the junctions of the mining galleries and the connecting galleries are provided with booms 4 that can be opened and closed as needed. When necessary, booms can also be arranged at sections between the ends of the galleries. In the situation shown in FIG. 1, the accepted operating area isolated for unmanned vehicles 5 comprises the connecting gallery 2*a* and the mining galleries l*b* and 1*d*. Correspondingly, the connecting gallery 2*b* and the mine gallery 1*c* are reserved for manned vehicles 6. Furthermore, mining galleries 1*a* and 1*e* are completely closed because of inspections or blasting operations, for example. It is naturally also possible that a plural number of isolated areas are arranged for unmanned vehicles by dividing the operating area with the booms, a separate unmanned vehicle being used in each area. This eliminates the risk of collision between the separate unmanned vehicles.

In this application, the term "barrier boom" is used to refer to a physical horizontal obstacle intentionally placed in a mine gallery, or the like, above the normal outer profile of a conventional mining vehicle and, at the same time, within the reach of a mast arranged on the mining vehicle, the boom thereby bordering the accepted operating range of the mining vehicle. The boom may be a tube or a protrusion provided with a desired cross-sectional profile and attached at one end to the wall of the mine gallery with a hinge allowing the boom to be pivoted to the side, parallel with the gallery, so that it does not function as a barrier. Further, the boom can be pivoted in a transverse position with respect to the gallery to restrict the travel area of the vehicle. The booms can also be suspended from the ceiling, which allows the accepted operating range to be more freely defined. The manufacturing of the booms and their installation in the mine is rapid and simple. The booms can be for example telescopically extendible or they may be assembled from prefabricated modules, whereby a boom suitable for each position of use may be assembled using standard parts. In addition, cable wires drawn across the gallery, or the like, may be used as barrier booms.

Figure 2:
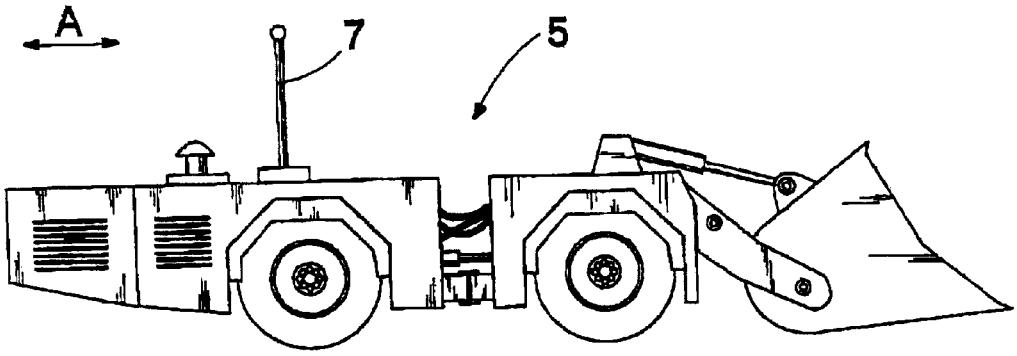
FIG. 2 is a schematic side view of a loading provided with the arrangement of the present invention.

FIG. 2 shows a schematic side view of a loading vehicle equipped with an emergency stop arrangement of the present invention. It is of course obvious that the mining vehicle can also be any other vehicle used in excavation industry, such as a rock drilling apparatus or a transport vehicle.

The device meant for unmanned use is provided with a control system based on wireless data transfer, which allows the device to be remotely operated from a control cabin on the ground, for example. Although the control system of such a vehicle comprises integrated safety arrangements for the steering and telecommunications arrangements applied by the vehicle, the safety of the vehicle is now enhanced by means of a mechanical emergency stop. For this purpose the upper part of the vehicle is provided with a mast 7 rising above the rest of the vehicle structure. The mast can naturally be positioned at another place than the one shown in FIG. 2, and there may also be more of them, one at each end of the vehicle, for example. In connection with the mast there is provided a switch, or the like, which triggers the emergency stop of the vehicle if the mast meets the barrier boom.

Figure 3:
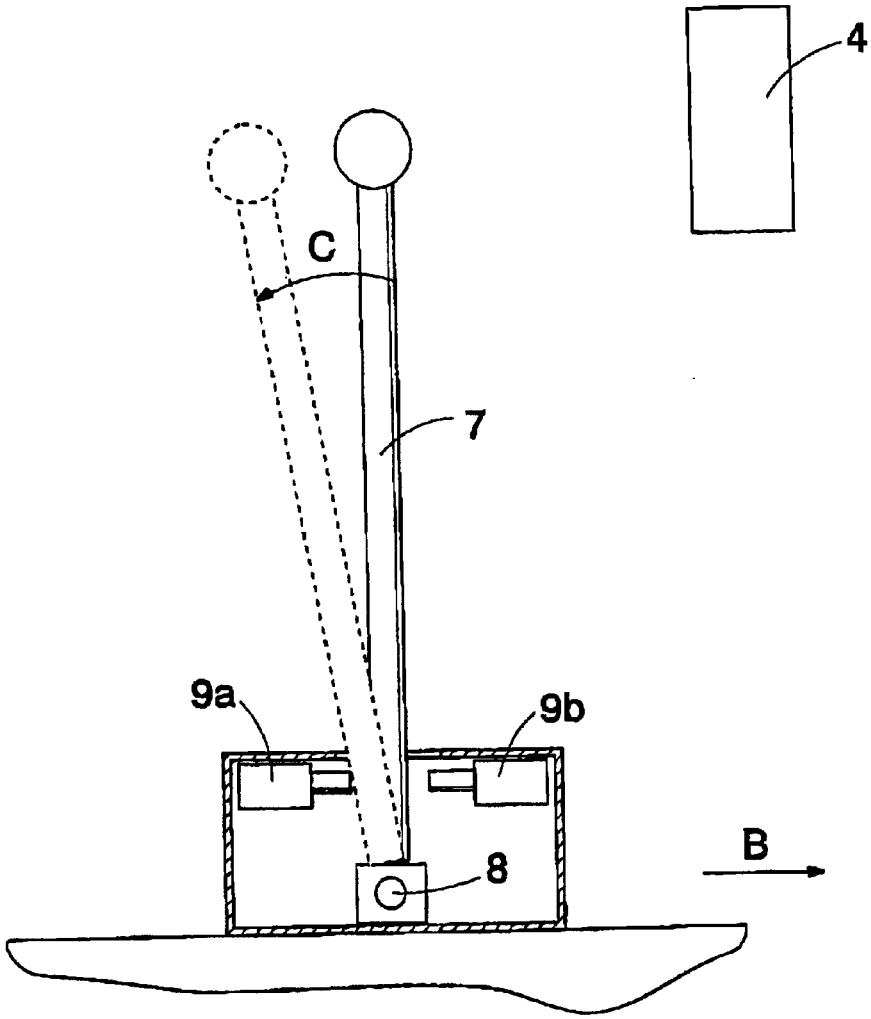
FIG. 3 is a schematic, enlarged sectional side view of the arrangement of the present invention.

As illustrated in FIG. 3, when the mast 7 hits the barrier boom 4, i.e. the mast bridges a gap between the highest point of the vehicle and the barrier boom, the mast 7 pivots with respect to the joint 8 arranged at its lower, foot end. In connection with the foot of the mast there are provided switches ga and gb which detect the pivoting of the mast and cause, either directly or indirectly, the emergency stop of the vehicle. A broken line is used in FIG. 3 to show the mast in a position where the mast has hit the boom in the travel direction B and pivoted, as a result, in the opposite direction C. The switch 9*a* thus triggers the emergency stop. In their simplest form, the switches are mechanical limit switches, but it is obvious that other kind of sensors and switches can also be used. Thus for example inductive proximity sensors or joints that break down due to the movement of the mast can be applied for this purpose.

In principle, the mast of the presently claimed arrangement, together with its emergency stop switches, can also be put into manned vehicles, in which case it is possible to prevent the vehicles from being driven, accidentally or for some other reason, into the operating area isolated for unmanned mining vehicles. It is also possible to arrange the booms located at the operating site to be remotely controlled, whereby the operating area can be changed, when necessary, for instance from the control room provided for unmanned mining vehicles. Furthermore, it is possible to use booms arranged at different heights and, correspondingly, masts of different heights, whereby some of the mining vehicles may be allowed to leave their own area and enter the area of another mining vehicle. When necessary, the height of the mast can be mechanically adjusted, or the vertical position of the booms changed.

It is also to be noted that wireless data transfer may comprise not only said radio connection, but also any other wireless data transfer, such as transfer based on wave energy, for example.

The drawings and the related specification are meant to only illustrate the idea of the present invention. The details of the present invention may vary within the scope of the claims.

What is claimed is:

1. A method for preventing the passage of a mining vehicle having a highest point, the method comprising the steps:

defining an accepted operating range for the mining vehicle; and controlling the vehicle so that it stays within the accepted operating range by stopping the vehicle if it tries to leave the operating range, wherein the defining step includes arranging at least one movable barrier boom at an operating site above the highest point of the mining vehicle, and the controlling step includes providing the mining vehicle with a mast to bridge a gap between the highest point and the barrier boom for triggering an emergency stop switch arranged in connection with the mast to stop the mining vehicle by the mast hitting the boom when the mining vehicle is at the barrier boom.

2. A method according to claim 1, wherein the mining vehicle is an unmanned mining vehicle.

3. A method according to claim 1, wherein the mining vehicle has its own power unit.

4. A method according to claim 1, comprising the further step of steering the mining vehicle by means of wireless data transfer.

5. A method according to claim 1, comprising the further step of steering the mining vehicle by means of an independent navigation system incorporated in the vehicle.

6. A method for preventing the passage of a mining vehicle having a highest point, the method comprising the steps of:

defining an acccepted operating range for the mining vehicle; and controlling the vehicle so that it stays within the accepted operating range by stopping the vehicle if it tries to leave the operating range, wherein the defining step includes arranging at least one barrier boom at an operating site above the highest point of the mining vehicle, and the controlling step includes providing the mining vehicle with a mast to bridge a gap between the highest point and the barrier boom for triggering an emergency stop switch arranged in connection with the mast to stop the mining vehicle by the mast hitting the boom when the mining vehicle is at the barrier boom, and the defining step further includes arranging a plurality of movable barrier booms at desired points of the operating site and altering the accepted operating range of the mining vehicle by changing the position of the barrier boom.

7. A method for preventing the passage of a mining vehicle having a highest point, the method comprising the steps of:

defining an accepted operating range for the mining vehicle; and controlling the vehicle so that it stays within the accepted operating range by stopping the vehicle if it tries to leave the operating range, wherein the defining step includes arranging at least one barrier boom at an operating site above the highest point of the mining vehicle, and the controlling step includes providing the mining vehicle with a mast to bridge a gap between the highest point and the barrier boom for triggering an emergency stop switch arranged in connection with the mast to stop the mining vehicle by the mast hitting the boom when the mining vehicle is at the barrier boom, and the defining step further includes making the barrier booms as projecting beams which are turnably pivotable at one end to the wall of the mine gallery, the accepted operating range of the mining vehicle being determined by pivoting the booms in a transverse or longitudinal direction with respect to the mine gallery.

8. An arrangement for preventing the passage of a mining vehicle, comprising:

a mining vehicle;

a mast arranged on the mining vehicle, the mast extending above other portions of the mining vehicle a movable barrier boom positioned in a mine gallery above the other portions of the mining vehicle and adapted to be contacted by the mast; and an emergency stop switch adapted to stop the mining vehicle when the mast hits the barrier boom defining the operating range of the mining vehicle and arranged within a range of motion of the mast.

9. An arrangement according to claim 8, wherein, at a lower end of the mast, a joint is provided, the mast being adapted to pivot with respect to the joint when the mast hits the barrier boom and wherein pivoting of the mast is adapted to trigger the emergency stop switch.

10. An arrangement according to claim 9, wherein the emergency stop switch is a mechanical limit switch.

11. An arrangement according to claim 8, wherein the emergency stop switch is a mechanical limit switch.

12. An arrangement according to claim 8, wherein the mining vehicle is an unmanned mining vehicle.

13. An arrangement according to claim 8, wherein the mining vehicle includes its own power unit.

14. An arrangement according to claim 8, wherein the mining vehicle includes a steering arrangement adapted to be steered by means of wireless data transfer.

15. An arrangement according to claim 8, wherein the mining vehicle includes a steering arrangement adapted to be steered by means of an independent navigation system incorporated in the vehicle.

16. An arrangement according to claim 8, wherein the barrier boom includes a plurality of barrier booms adapted to be positioned in different locations.

17. An arrangement according to claim 8, wherein the barrier boom is pivotable relative to walls of the mine gallery.

* * * * *